US010931010B1

(12) United States Patent
Lin et al.

(10) Patent No.: US 10,931,010 B1
(45) Date of Patent: Feb. 23, 2021

(54) ANTI-EMI ANTENNA

(71) Applicant: KaiKuTek Inc., Taipei (TW)

(72) Inventors: Yi-Cheng Lin, Taipei (TW); Mike Chun-Hung Wang, Taipei (TW); He-Sheng Lin, Taoyuan (TW)

(73) Assignee: KaiKuTek Inc., Taipei (TW)

( * ) Notice: Subject to any disclaimer, the term of this patent is extended or adjusted under 35 U.S.C. 154(b) by 0 days.

(21) Appl. No.: 16/527,125

(22) Filed: Jul. 31, 2019

(51) Int. Cl.

| | |
|---|---|
| ***H01Q 1/52*** | (2006.01) |
| ***H01Q 1/38*** | (2006.01) |
| ***H01Q 9/04*** | (2006.01) |
| ***H01Q 5/328*** | (2015.01) |

(52) U.S. Cl.
CPC ..... *H01Q 1/526* (2013.01); *H01Q 1/38* (2013.01); *H01Q 5/328* (2015.01); *H01Q 9/0407* (2013.01)

(58) Field of Classification Search
CPC ..... H01Q 1/526; H01Q 5/328; H01Q 1/38; H01Q 9/0407; H01Q 1/2283; H01Q 23/00; H01L 21/561; H01L 21/568; H01L 2223/6677; H01L 2224/04105; H01L 2224/05572; H01L 2224/12105; H01L 2224/16225; H01L 2224/81; H01L 2224/97; H01L 23/3128; H01L 23/481; H01L 23/49805; H01L 23/5225; H01L 23/5227; H01L 23/5389; H01L 23/552; H01L 24/16; H01L 24/19; H01L 24/96; H01L 24/97; H01L 25/16; H01L 2924/00; H01L 2924/00012; H01L 2924/12042; H01L 2924/15311; H01L 2924/15313; H01L 2924/15787; H01L 2924/181; H01L 2924/1815; H01L 2924/19105; H01L 2924/3025
See application file for complete search history.

(56) References Cited

U.S. PATENT DOCUMENTS

| | | | | |
|---|---|---|---|---|
| 7,675,465 | B2 * | 3/2010 | Doan | H01Q 1/38 343/700 MS |
| 9,589,909 | B1 * | 3/2017 | Yap | H01L 23/49822 |
| 10,707,560 | B1 * | 7/2020 | Ke | H01Q 1/526 |
| 2006/0049995 | A1 * | 3/2006 | Imaoka | H01Q 1/2283 343/702 |
| 2007/0285318 | A1 * | 12/2007 | Sotoudeh | H01Q 1/243 343/702 |
| 2011/0163457 | A1 * | 7/2011 | Mohan | H01L 25/0652 257/774 |
| 2012/0280366 | A1 * | 11/2012 | Kamgaing | H01L 23/66 257/621 |
| 2014/0035097 | A1 * | 2/2014 | Lin | H01L 23/66 257/531 |

(Continued)

*Primary Examiner* — Renan Luque
(74) *Attorney, Agent, or Firm* — Rabin & Berdo, P.C.

(57) ABSTRACT

An anti-EMI antenna includes a first substrate layer, a grounding layer, a first circuit layer, a second substrate layer, a second circuit layer, a third substrate layer, a third circuit layer, a fourth substrate layer, and a fourth circuit layer. The grounding layer is mounted on a bottom surface of the first substrate layer, and includes a grounding circuit. The grounding circuit fully covers the bottom surface of the first substrate layer. Since the grounding circuit fully covers the bottom surface of the first substrate layer, the antenna radiation circuit can prevent the EMI from a bottom side of the anti-EMI antenna. Therefore, electromagnetic waves can be mostly isolated to prevent noise caused by the EMI.

7 Claims, 3 Drawing Sheets

(56) References Cited

U.S. PATENT DOCUMENTS

| | | | | |
|---|---|---|---|---|
| 2016/0268213 | A1* | 9/2016 | Jiang | H01L 24/32 |
| 2018/0159203 | A1* | 6/2018 | Baks | H01Q 9/0407 |
| 2018/0286815 | A1* | 10/2018 | Qi | H01L 23/49838 |
| 2020/0161204 | A1* | 5/2020 | Kim | H01L 23/3128 |

* cited by examiner

ANTI-EMI ANTENNA

BACKGROUND OF THE INVENTION

1. Field of the Invention

The present invention relates to an antenna, and more particularly to an anti-electromagnetic-interference (anti-EMI) antenna.

2. Description of the Related Art

An electronic device usually includes a wireless communicating function. Therefore, the electronic device may include an antenna or a wireless transceiver for supporting the wireless communicating function.

However, the electronic device further includes a plurality of integrated circuits (ICs). When the electronic device is operated, the ICs may generate electromagnetic waves. The electromagnetic waves generated by the ICs may cause noise to interfere with the antenna mounted in the electronic device. Therefore, the antenna mounted in the electronic device needs to be further improved.

SUMMARY OF THE INVENTION

An objective of the present invention is to provide an anti-electromagnetic-interference (anti-EMI) antenna. The present invention may protect the anti-EMI antenna from EMI. The anti-EMI antenna includes a first substrate layer, a grounding layer, a first circuit layer, a second substrate layer, a second circuit layer, a third substrate layer, a third circuit layer, a fourth substrate layer, and a fourth circuit layer.

The grounding layer is mounted on a bottom surface of the first substrate layer, and includes a grounding circuit. The grounding circuit fully covers the bottom surface of the first substrate layer. The first circuit layer includes an antenna signal circuit and a plurality of first grounding circuits. The first grounding circuits are mounted around the antenna signal circuit. The first circuit layer is mounted between a top surface of the first substrate layer and on a bottom surface of the second substrate layer.

The second circuit layer includes a first antenna circuit, a second antenna circuit, and a plurality of second grounding circuits. The second grounding circuits are mounted around the first antenna circuit and the second antenna circuit.

The third substrate layer includes a first antenna via, a second antenna via, and a plurality of grounding vias. The second circuit layer is mounted between a top surface of the second substrate layer and a bottom surface of the third substrate layer. The grounding vias are mounted around the first antenna via and the second antenna via. The first antenna circuit and the second antenna circuit are electrically connected to the antenna signal circuit through the second substrate layer. The second grounding circuits are electrically connected to the first grounding circuits through the second substrate layer.

The third circuit layer includes a third antenna circuit, a fourth antenna circuit, and a plurality of third grounding circuits. The third circuit layer is mounted between a top surface of the third substrate layer and a bottom surface of the fourth substrate layer.

Two opposite ends of the first antenna via are respectively electrically connected to the first antenna circuit and the third antenna circuit. Two opposite ends of the second antenna via are respectively electrically connected to the second antenna circuit and the fourth antenna circuit.

The fourth circuit layer is mounted on a top surface of the fourth substrate layer, and includes an antenna radiation circuit and a plurality of fourth grounding circuits. The fourth grounding circuits are mounted around the antenna radiation circuit. The antenna radiation circuit is electrically connected to the third antenna circuit and the fourth antenna circuit through the fourth substrate layer. The fourth grounding circuits are electrically connected to the third grounding circuit through the fourth substrate layer.

Since the grounding circuit fully covers the bottom surface of the first substrate layer, the antenna radiation circuit can prevent the EMI from a bottom side of the anti-EMI antenna. Further, since the first grounding circuits, the second grounding circuits, the grounding vias, and the fourth grounding circuits are respectively mounted around the antenna signal circuit, the two second antenna circuits, the first antenna via, the second antenna via, and the antenna radiation circuit, the EMI can be isolated.

Namely, the grounding circuit, the first grounding circuits, the second grounding circuits, the grounding vias, and the fourth grounding circuits form an isolating wall. The isolating wall includes a cavity to accommodate the antenna signal circuit, the first antenna circuit, the second antenna circuit, the first antenna via, the second antenna via, and the antenna radiation circuit. Therefore, electromagnetic waves can be mostly isolated to prevent noise caused by the EMI.

DETAILED DESCRIPTION OF THE INVENTION

Figure 1:
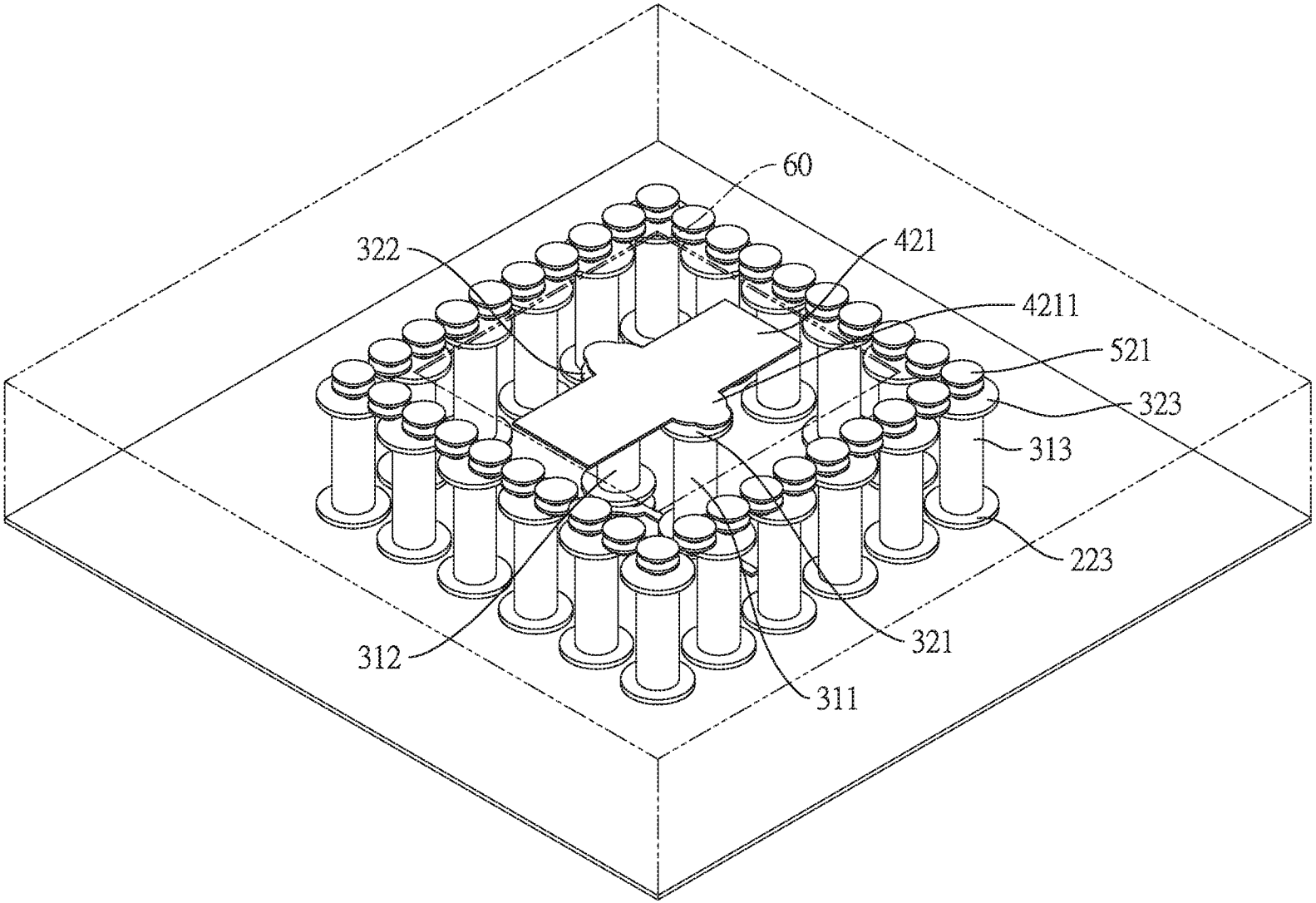
FIG. 1 is a schematic view of an embodiment of an anti-EMI antenna of the present invention.
Figure 2:
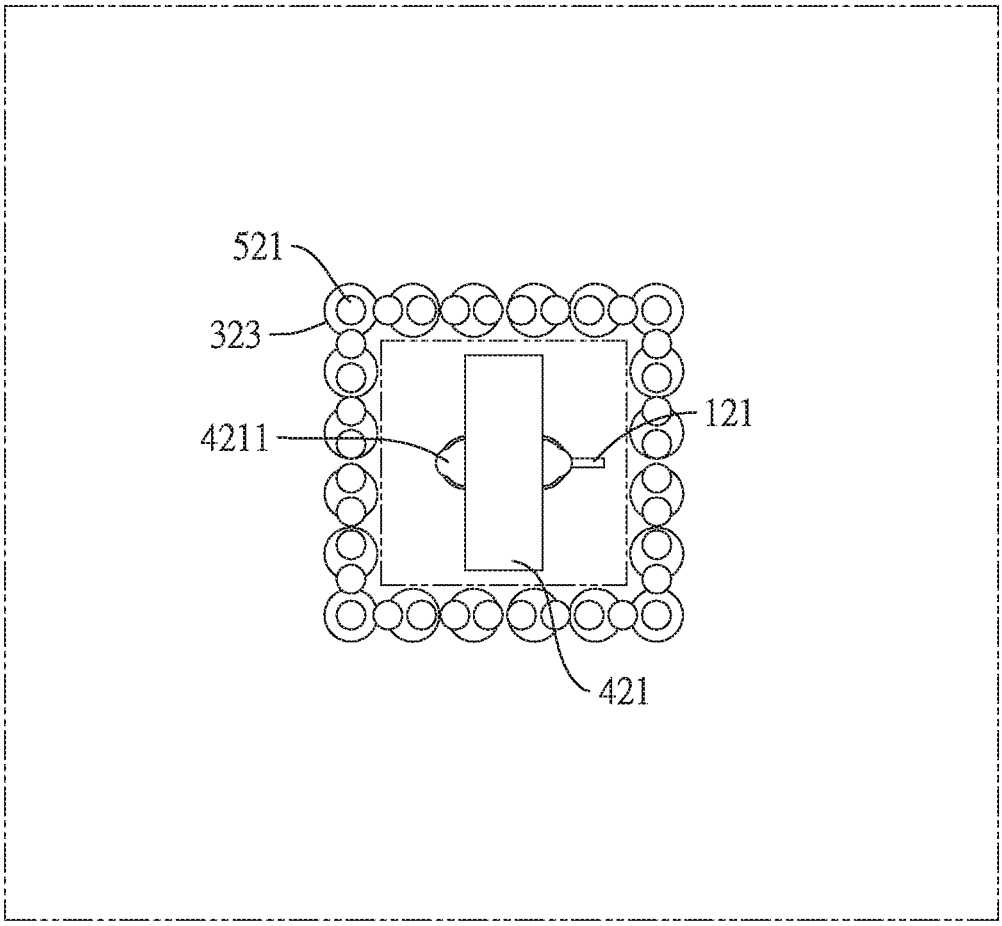
FIG. 2 is a top view of the embodiment of the anti-EMI antenna of the present invention.
Figure 3:
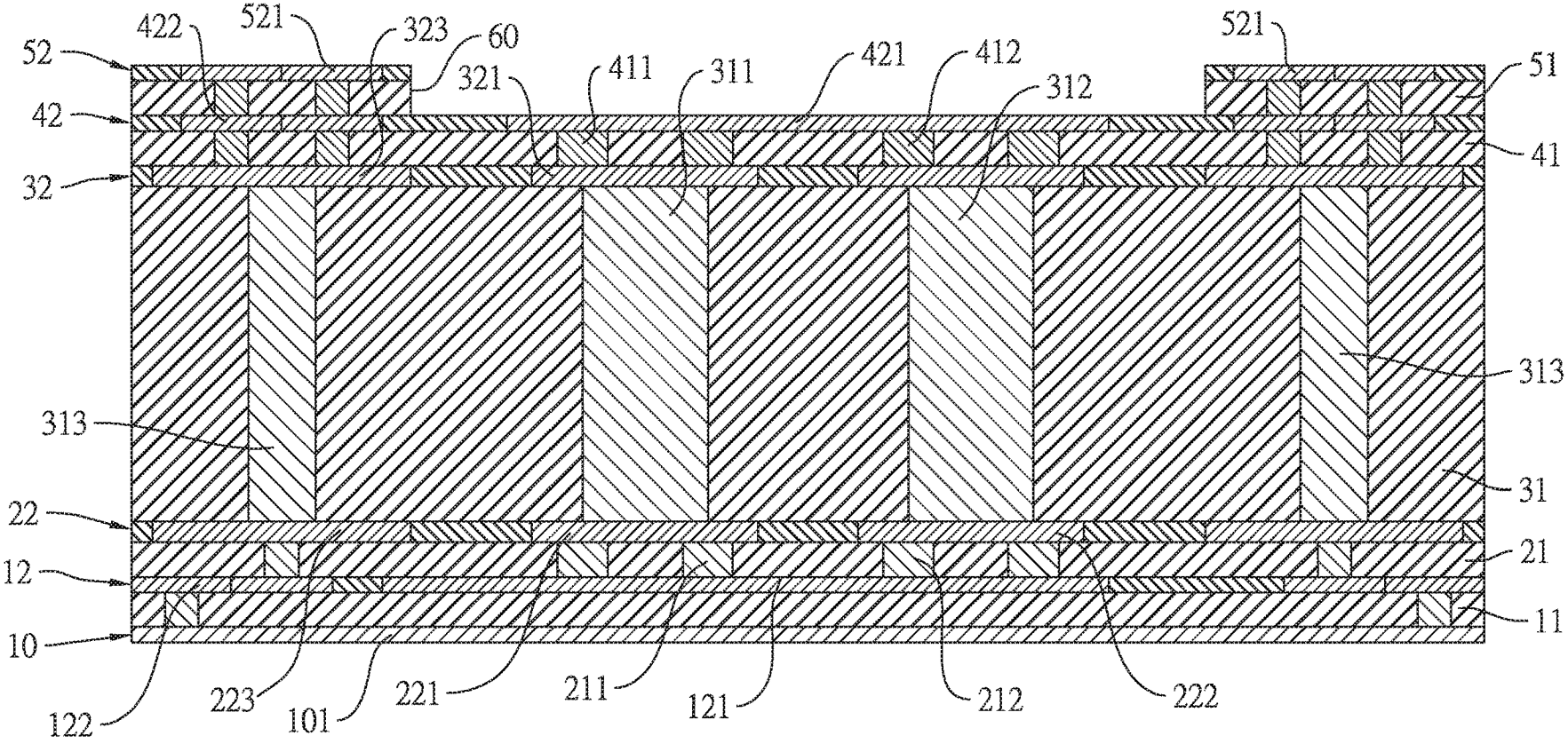
FIG. 3 is a cross sectional view of the embodiment of the anti-EMI antenna of the present invention.

With reference to FIGS. 1 to 3, the present invention relates to an anti-EMI antenna. The anti-EMI antenna includes a grounding layer 10, a first substrate layer 11, a first circuit layer 12, a second substrate layer 21, a second circuit layer 22, a third substrate layer 31, a third circuit layer 32, a fourth substrate layer 41, and a fourth circuit layer 42.

The grounding layer 10 is mounted on a bottom surface of the first substrate layer 11, and includes a grounding circuit 101. The grounding circuit 101 fully covers the bottom surface of the first substrate layer 11. The first circuit layer 12 includes an antenna signal circuit 121 and a plurality of first grounding circuits 122. The first grounding circuits 122 are mounted around the antenna signal circuit 121. The first circuit layer 12 is mounted between a top surface of the first substrate layer 11 and on a bottom surface of the second substrate layer 21.

The second circuit layer 22 includes a first antenna circuit 221, a second antenna circuit 222, and a plurality of second grounding circuits 223. The second grounding circuits 223 are mounted around the first antenna circuit 221 and the second antenna circuit 222.

The third substrate layer 31 includes a first antenna via 311, a second antenna via 312, and a plurality of grounding vias 313. The second circuit layer 22 is mounted between a top surface of the second substrate layer 21 and a bottom surface of the third substrate layer 31. The grounding vias 313 are mounted around the first antenna via 311 and the second antenna via 312. The first antenna circuit 221 and the second antenna circuit 222 are electrically connected to the antenna signal circuit 121 through the second substrate layer 21. The second grounding circuits 223 are electrically connected to the first grounding circuits 122 through the second substrate layer 21.

The third circuit layer 32 includes a third antenna circuit 321, a fourth antenna circuit 322, and a plurality of third grounding circuits 323. The third circuit layer 32 is mounted between a top surface of the third substrate layer 31 and a bottom surface of the fourth substrate layer 41.

Two opposite ends of the first antenna via 311 are respectively electrically connected to the first antenna circuit 221 and the third antenna circuit 321. Two opposite ends of the second antenna via 312 are respectively electrically connected to the second antenna circuit 222 and the fourth antenna circuit 322.

The fourth circuit layer 42 is mounted on a top surface of the fourth substrate layer 41, and includes an antenna radiation circuit 421 and a plurality of fourth grounding circuits 422. The fourth grounding circuits 422 are mounted around the antenna radiation circuit 421. The antenna radiation circuit 421 is electrically connected to the third antenna circuit 321 and the fourth antenna circuit 322 through the fourth substrate layer 41. The fourth grounding circuits 422 are electrically connected to the third grounding circuits 323 through the fourth substrate layer 41.

The grounding circuit, the first grounding circuits, the second grounding circuits, the grounding vias, and the fourth grounding circuits form an isolating wall. The isolating wall includes a cavity to accommodate the antenna signal circuit 121, the first antenna circuit 211, the second antenna circuit 212, the first antenna via 311, the second antenna via 312, and the antenna radiation circuit 421. When the anti-EMI antenna is mounted in an electronic device, electromagnetic waves generated by integrated circuits (ICs) of the electronic device can be mostly isolated to prevent noise caused by the EMI.

Moreover, the anti-EMI antenna further includes a fifth substrate layer 51 and a fifth circuit layer 52. The fourth circuit layer 42 is mounted between the top surface of the fourth substrate layer 41 and a bottom surface of the fifth substrate layer 51. The fifth circuit layer 52 is mounted on a top surface of the fifth substrate layer 51, and includes a plurality of fifth grounding circuits 521. The fifth grounding circuits 521 are electrically connected to the fourth grounding circuit 422 through the fifth substrate layer 51.

Since the anti-EMI antenna further includes the fifth substrate layer 51 and the fifth circuit layer 52, the fifth grounding circuits 521 can be higher than the antenna radiation circuit 421. Therefore, an edge of the isolating wall can be higher than the antenna radiation circuit 421 to provide more efficient anti-EMI antenna performance.

Further, a through hole 60 is formed through the fifth substrate layer 51 and the fifth circuit layer 52, and the antenna radiation circuit 421 can be exposed from the through hole 60.

The second substrate layer 21 includes two first connecting vias 211 and two second connecting vias 222. The first antenna circuit 221 is electrically connected to the antenna signal circuit 121 through the two first connecting vias 211 of the second substrate layer 21. The second antenna circuit 222 is electrically connected to the antenna signal circuit 121 through the two second connecting vias 212 of the second substrate layer 21.

The fourth substrate layer 41 includes two third connecting vias 411 and two fourth connecting vias 412. The third antenna circuit 321 is electrically connected to the antenna radiation circuit 421 through the two third connecting vias 411 of the fourth substrate layer 41. The fourth antenna circuit 322 is electrically connected to the antenna radiation circuit 421 through the two fourth connecting vias 412 of the fourth substrate layer 41.

With reference to FIG. 2, the antenna radiation circuit 421 of the fourth circuit layer 42 is a rectangular patch, and the rectangular patch includes two connecting parts 4211. The two connecting parts 4211 are each respectively extended from two long sides of the rectangular patch.

One of the two connecting parts 4211 is electrically connected to the third antenna circuit 321 through the two third connecting vias 411 of the fourth substrate layer 41, and the other one of the two connecting parts 4211 is electrically connected to the fourth antenna circuit 322 through the two fourth connecting vias 412 of the fourth substrate layer 41.

Further, the two connecting parts 4211 are each respectively extended from middles of the two long sides of the rectangular patch.

The antenna radiation circuit 421 is the rectangular patch having the two connecting parts 4211 each respectively extended from the middles of the two long sides of the rectangular patch. Therefore, the anti-EMI antenna has a LC-balanced feeding design for enhancing antenna efficiency and bandwidth.

In conclusion, since the isolating wall includes the cavity to accommodate the antenna signal circuit 121, the first antenna circuit 211, the second antenna circuit 212, the first antenna via 311, the second antenna via 312, and the antenna radiation circuit 421, the anti-EMI antenna is a cavity backed antenna. Namely, the anti-EMI antenna has a cavity backed design for gain enhancement.

Moreover, the grounding circuit 101 includes a plurality of connecting holes. The antenna signal circuit 121 is mounted near the bottom of the anti-EMI antenna, and the antenna signal circuit 121 can be electrically connected to an outer printed circuit board (PCB) through the connecting holes for transmitting signals. Therefore, the antenna signal circuit 121 can be electrically connected to the PCB, and can be isolated from the grounding circuit 101. Namely, the anti-EMI antenna also has a bottom-fed design for size reduction.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An anti-Electromagnetic-Interference (anti-EMI) antenna, comprising:

a first substrate layer;

a grounding layer, mounted on a bottom surface of the first substrate layer, and comprising a grounding circuit; wherein the grounding circuit fully covers the bottom surface of the first substrate layer;

a first circuit layer, comprising an antenna signal circuit and a plurality of first grounding circuits; wherein the first grounding circuits are mounted around the antenna signal circuit;

a second substrate layer; wherein the first circuit layer is mounted between a top surface of the first substrate layer and on a bottom surface of the second substrate layer;

a second circuit layer, comprising a first antenna circuit, a second antenna circuit, and a plurality of second grounding circuits; wherein the second grounding circuits are mounted around the first antenna circuit and the second antenna circuit;

a third substrate layer, comprising a first antenna via, a second antenna via, and a plurality of grounding vias;

wherein the second circuit layer is mounted between a top surface of the second substrate layer and a bottom surface of the third substrate layer;

wherein the grounding vias are mounted around the first antenna via and the second antenna via;

wherein the first antenna circuit and the second antenna circuit are electrically connected to the antenna signal circuit through the second substrate layer;

wherein the second grounding circuits are electrically connected to the first grounding circuits through the second substrate layer;

a third circuit layer, comprising a third antenna circuit, a fourth antenna circuit, and a plurality of third grounding circuits;

a fourth substrate layer; wherein the third circuit layer is mounted between a top surface of the third substrate layer and a bottom surface of the fourth substrate layer;

wherein two opposite ends of the first antenna via are respectively electrically connected to the first antenna circuit and the third antenna circuit;

wherein two opposite ends of the second antenna via are respectively electrically connected to the second antenna circuit and the fourth antenna circuit;

a fourth circuit layer, mounted on a top surface of the fourth substrate layer, and comprising an antenna radiation circuit and a plurality of fourth grounding circuits;

wherein the fourth grounding circuits are mounted around the antenna radiation circuit;

wherein the antenna radiation circuit is electrically connected to the third antenna circuit and the fourth antenna circuit through the fourth substrate layer;

wherein the fourth grounding circuits are electrically connected to the third grounding circuit through the fourth substrate layer; and wherein the second substrate layer comprises:

two first connecting vias; wherein the first antenna circuit is electrically connected to the antenna signal circuit through the two first connecting vias of the second substrate layer; and two second connecting vias; wherein the second antenna circuit is electrically connected to the antenna signal circuit through the two second connecting vias of the second substrate layer.

2. The anti-EMI antenna as claimed in claim 1, further comprising:

a fifth substrate layer; wherein the fourth circuit layer is mounted between the top surface of the fourth substrate layer and a bottom surface of the fifth substrate layer;

a fifth circuit layer, mounted on a top surface of the fifth substrate layer, and comprising a plurality of fifth grounding circuits;

wherein the fifth grounding circuits are electrically connected to the fourth grounding circuits through the fifth substrate layer.

3. The anti-EMI antenna as claimed in claim 1, wherein the fourth substrate layer comprises:

two third connecting vias; wherein the third antenna circuit is electrically connected to the antenna radiation circuit through the two third connecting vias of the fourth substrate layer;

two fourth connecting vias; wherein the fourth antenna circuit is electrically connected to the antenna radiation circuit through the two fourth connecting vias of the fourth substrate layer.

4. The anti-EMI antenna as claimed in claim 2, wherein the fourth substrate layer comprises:

two third connecting vias; wherein the third antenna circuit is electrically connected to the antenna radiation circuit through the two third connecting vias of the fourth substrate layer;

two fourth connecting vias; wherein the fourth antenna circuit is electrically connected to the antenna radiation circuit through the two fourth connecting vias of the fourth substrate layer.

5. The anti-EMI antenna as claimed in claim 3, further comprising a through hole;

wherein the through hole is formed through the fifth substrate layer and the fifth circuit layer to expose the antenna radiation circuit.

6. The anti-EMI antenna as claimed in claim 5, wherein the antenna radiation circuit of the fourth circuit layer is a rectangular patch, and the rectangular patch comprises two connecting parts;

wherein the two connecting parts are each respectively extended from two long sides of the rectangular patch;

wherein one of the two connecting parts is electrically connected to the third antenna circuit through the two third connecting vias of the fourth substrate layer, and the other one of the two connecting parts is electrically connected to the fourth antenna circuit through the two fourth connecting vias of the fourth substrate layer.

7. The anti-EMI antenna as claimed in claim 6, wherein the two connecting parts are each respectively extended from middles of the two long sides of the rectangular patch.

* * * * *